US006141810A

United States Patent [19]

Allen et al.

[11] Patent Number: 6,141,810

[45] Date of Patent: Nov. 7, 2000

[54] REMOTE CONTROLLED SLUDGE REMOVAL SYSTEM

[76] Inventors: Henry W. Allen, 4134 Lake Limestone Ct., Baton Rouge, La. 70816; Daryl T. Brown, 4735 Y.A. Title Ave., Apt. 1, Baton Rouge, La. 70820; John A. Endres, 12636 Fairhaven Dr., Baton Rouge, La. 70815

[21] Appl. No.: 09/206,548

[22] Filed: Dec. 7, 1998

[51] Int. Cl.[7] ..... B08B 9/08

[52] U.S. Cl. ..... 15/1.7; 15/302; 15/340.1; 15/93.1

[58] Field of Search ..... 15/1.7, 340.1, 15/3, 302, 93.1, 340.3, 340.4; 134/8

[56] References Cited

U.S. PATENT DOCUMENTS

| | | | |
|---|---|---|---|
| 1,474,456 | 11/1923 | Watson . | |
| 1,820,743 | 8/1931 | Honstain . | |
| 2,581,183 | 1/1952 | Galamb . | |
| 3,307,882 | 3/1967 | McFayden . | |
| 3,586,109 | 6/1971 | Eversole et al. . | |
| 3,912,338 | 10/1975 | Toews . | |
| 3,958,294 | 5/1976 | Thompson . | |
| 4,191,590 | 3/1980 | Sundheim . | |
| 4,218,101 | 8/1980 | Thompson . | |
| 4,407,035 | 10/1983 | Lindqvist | 15/93.1 X |
| 4,675,052 | 6/1987 | Badinier et al. . | |
| 4,827,563 | 5/1989 | Gordon . | |
| 4,858,697 | 8/1989 | Sherblom . | |
| 5,014,791 | 5/1991 | Kure . | |
| 5,078,799 | 1/1992 | Matter . | |
| 5,138,741 | 8/1992 | Allen | 15/340.1 |
| 5,269,041 | 12/1993 | Allen | 15/340.1 |
| 5,279,012 | 1/1994 | Sloan | 15/1.7 |
| 5,293,887 | 3/1994 | Thibodeaux . | |
| 5,301,702 | 4/1994 | McKinney . | |
| 5,312,044 | 5/1994 | Eaton . | |
| 5,335,395 | 8/1994 | Allen | 15/340.1 |
| 5,561,883 | 10/1996 | Landry et al. | 15/322 X |
| 5,632,342 | 5/1997 | Knoblich et al. . | |
| 5,640,982 | 6/1997 | Landry et al. . | |
| 5,676,437 | 10/1997 | Holmgren et al. . | |
| 5,740,821 | 4/1998 | Arnold . | |
| 5,749,384 | 5/1998 | Hayashi et al. . | |

OTHER PUBLICATIONS

RedZone Robotics Internet address: http://www.red-zone.com/houdini.html.

Federal Energy Technology Center Internet address: http://www.fetc.doe.gov/publications/factsheets/ewm/dd/32092.pdf.

*Primary Examiner*—Chris K. Moore

*Attorney, Agent, or Firm*—David L. Ray

[57] ABSTRACT

A movable sediment and sludge removal and cleaning system which can be inserted into the access pipe of a storage tank, the apparatus including a chassis or platform, a pump connected to the chassis, two track assemblies connected to the chassis movable relative to the chassis in the same plane as the chassis, movable tracks connected to each track assembly to drive the apparatus over sediment and sludge, and a motor for driving the track assemblies and pump.

14 Claims, 10 Drawing Sheets

REMOTE CONTROLLED SLUDGE REMOVAL SYSTEM

BACKGROUND OF THE INVENTION

1. Field of the Invention

The invention is related to devices for cleaning storage tanks. In particular, the invention is related to cleaning waste products from storage tanks which have a high percentage of solids therein. In particular the present invention is related to devices for removing sediment and sludge that accumulates in waste storage tanks.

2. Description of the Related Art

The accumulation of sediment and sludge in storage tanks is common throughout the world. Prior to the invention disclosed in U.S. Pat. Nos. 5,138,741, 5,269,041 and 5,335,395, many storage tanks such as oil storage tanks were periodically cleaned by manned crews which manually shoveled out the sludge which had accumulated on the bottom of the tank.

The invention disclosed in the aforementioned patents could be fitted within a common hatch or manhole which are typically 24 inches in diameter. Such 24 inch diameter circular hatches or manholes are commonly used in the great majority of storage tanks.

Some storage tanks have access ports or access pipes which are much smaller than the 24 inch common manhole or circular hatch found in most storage tanks. In particular, certain nuclear waste sites have access ports and access pipes which have a maximum 12 inch diameter access pipe or port and are inaccessible by the sludge and sediment removal apparatus of the prior art without enlarging the diameter of the access port or reducing the dimensions of the sludge removal apparatus to an impractical size. Creating a larger access port for insertion of a sludge removal apparatus is very expensive in such tanks, and it is thus desirable to provide a sludge removal apparatus that will can be inserted into such tanks through existing small diameter access ports.

SUMMARY OF THE INVENTION

In accordance with the present invention there is provided a movable sediment and sludge removal and cleaning system which can be inserted into the access pipe of a storage tank, the apparatus including a chassis or platform, a pump connected to the chassis, two track assemblies connected to the chassis movable relative to the chassis in the same plane as the chassis, movable tracks connected to each track assembly to drive the apparatus over sediment and sludge, and a motor for driving the track assemblies and pump.

One of the principal advantages of the present invention is that the apparatus can be inserted through a 12 inch opening in a storage tank and effectively and economically remove sludge and waste from the tank.

DESCRIPTION OF THE PREFERRED EMBODIMENTS

Figure 3:
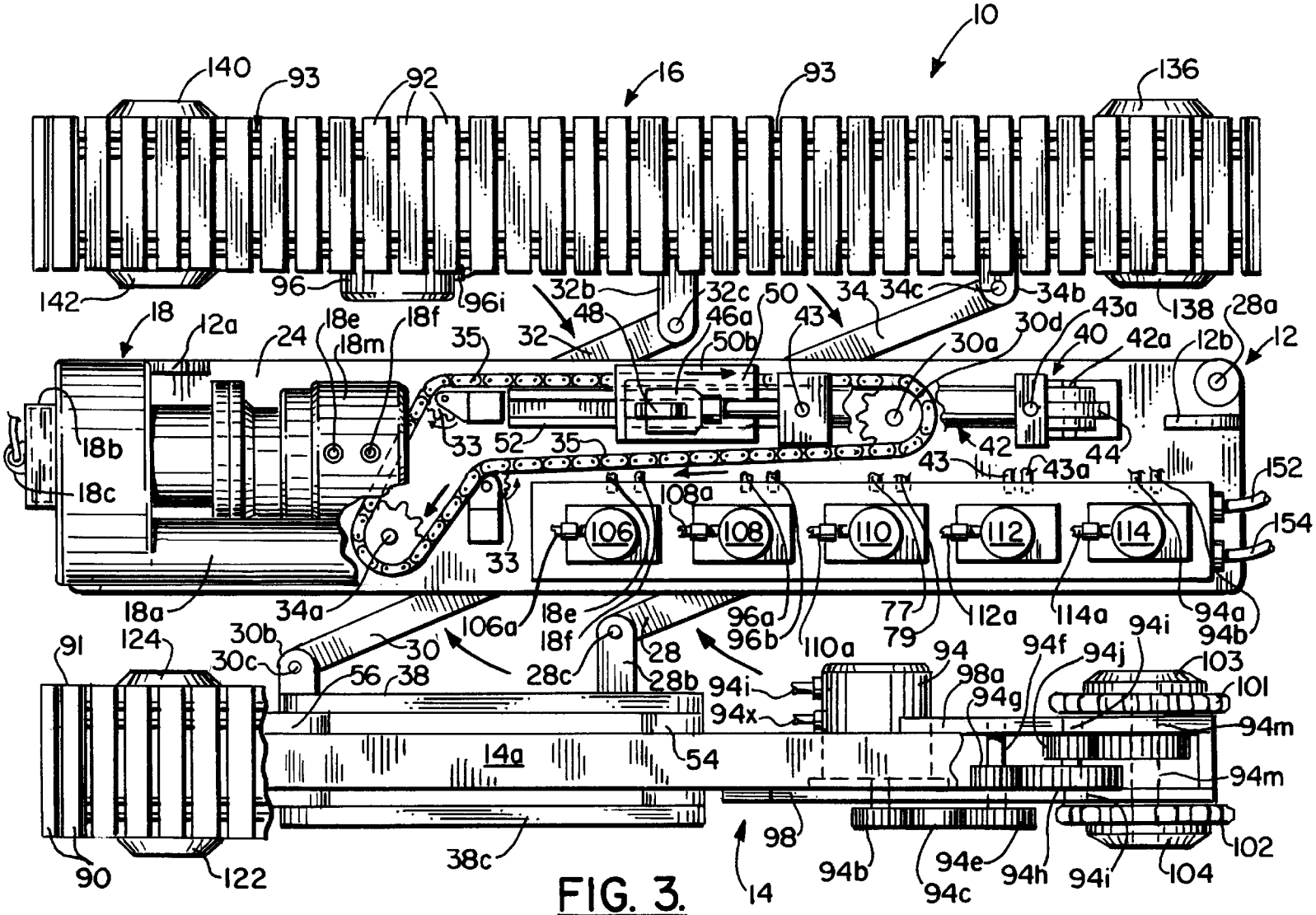
FIG. 3 is a schematic, partially cut-away, top view of the apparatus invention shown in FIGS. 1*a*, 1*b*, and 1*c* and FIGS. 2*a*, 2*b*, and 2*c* when the track assemblies of the invention are positioned parallel to the chassis of the invention.
Figure 8:
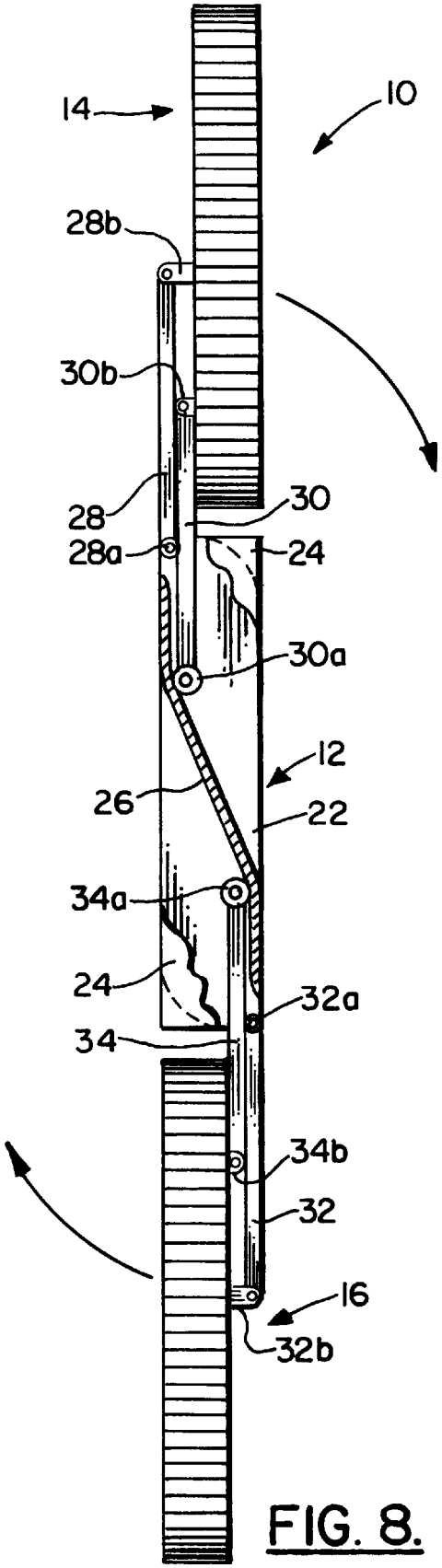
FIG. 8 is a schematic, partly cut-away, partly cross-sectional, top view of the invention with the track assemblies shown in alignment with the chassis of the invention.
Figure 9:
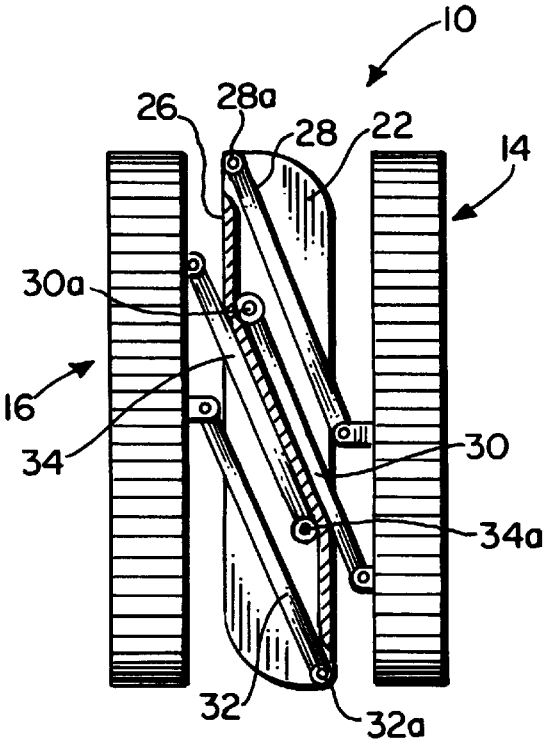
FIG. 9 is a schematic, partly cut-away, bottom view of the apparatus of the invention with the track assemblies moved in a position parallel to the chassis of the invention.

Referring now to the drawings, and in particular FIGS. 3, 8, and 9, the sludge removal apparatus of the invention can be seen to be generally indicated by the numeral 10. By sludge is meant the nuclear waste sediment present in nuclear waste storage tanks, the viscous residue of hydrocarbons such as crude oil, or other sludge contained in waste storage tanks or sludge pits.

The sludge removal apparatus 10 includes a platform or chassis generally indicated by the numeral 12 which is rotatably connected to two identical track assemblies generally indicated by the numerals 14 and 16. Track assemblies 14 and 16 drive apparatus 10 over the area to be cleaned such as the bottom 17*b* of tank 17 shown in FIGS. 4, 5, and 6. The basic design of track assemblies 14 and 16 is similar to a conventional "bulldozer" track mechanism well known in the art, and track assemblies 14 and 16 are identical in design and construction.

Unlike conventional track mechanisms of the prior art, track assemblies 14 and 16 swing to the front and rear of chassis 12 as shown in FIGS. 4, 5, 8, and 9 to enable apparatus 10 to be inserted in a small opening 17*a* in a storage tank generally indicated by the numeral 17.

Mounted on chassis 12 is a pump generally indicated by the numeral 18 for pumping sludge from the area or tank in which sludge removal apparatus is operated. Pump 18 has a motor 18*m*, which is preferably a hydraulic motor, a discharge pipe 18*a*, and an intake 18*b* connected thereto. Motor 18*m* is supplied with hydraulic fluid through hydraulic hose 18*e*, and hydraulic fluid exits through hydraulic hose 18*f*. Intake 18*b* has a movable inner hollow suction member 19 which can move upward and downward as indicated by the arrow in FIG. 2*b*.

Figure 4:
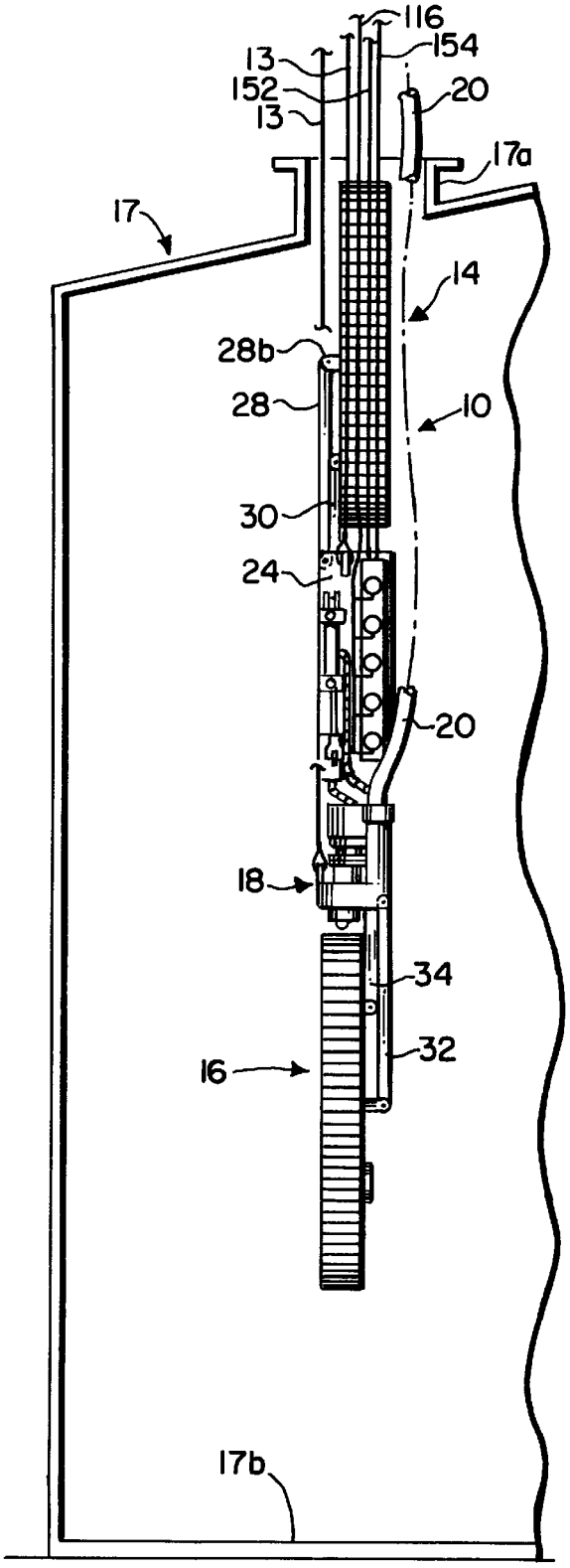
FIG. 4 is a schematic view of the apparatus of the invention being lowered into an opening of a storage tank.
Figure 5:
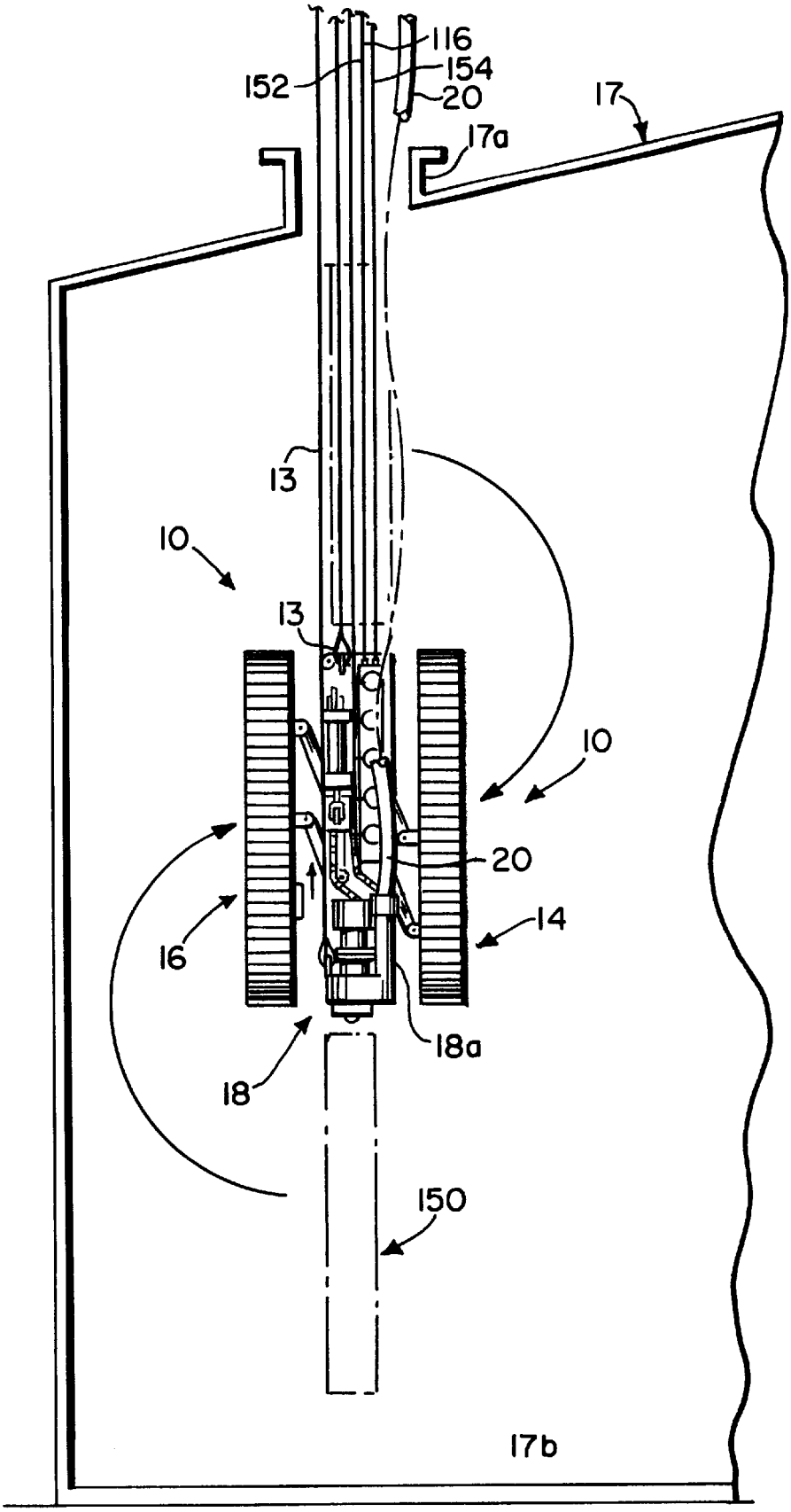
FIG. 5 is a schematic view of the apparatus of the invention showing the track assemblies moved into position parallel to the chassis of the invention prior to lowering the apparatus to the floor of the storage tank.
Figure 6:
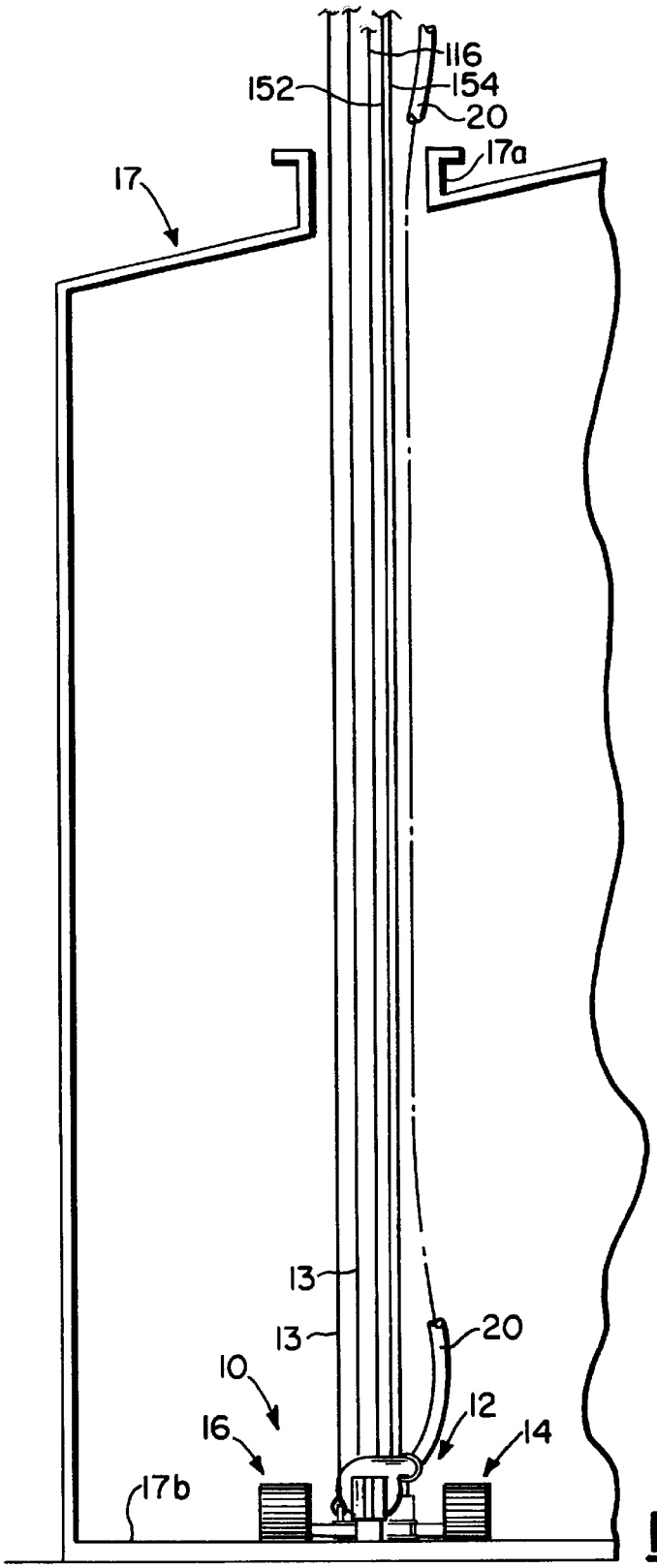
FIG. 6 is a schematic view of the apparatus of the invention shown lowered to the bottom of a storage tank with the chassis 12 in its lower position relative to the two track assemblies 14 and 16.

The upward and downward movement of intake 18*b* is controlled by solenoid 18*c*, which receives electrical control signals through electrical lines 18*d*. Electrical lines 18*d* extend from solenoid 18*c* to wire bundle 116. Wire bundle 116 extends to a conventional electronic control device (not shown) located on the outside of the tank 17 or other area being cleaned by apparatus 10 as shown in FIGS. 4, 5, and 6. A hose 20 shown in FIGS. 4–6 and indicated in phantom lines in FIG. 2B may be connected to discharge pipe 18*a* of pump 18 to convey sludge from the inside of the tank 17 or other area being cleaned to holding tanks (not shown) or the like on the outside of the tank 17 or other area being cleaned.

Pump 18 is preferably a submersible pump designed to pump viscous liquids such as crude oil and other liquids and slurries having a high percentage of solids therein. Preferably pump 18 is capable of pumping liquified sludge or slurries of sludge and/or sediment containing 25 percent or more of solids.

Figure 2A:
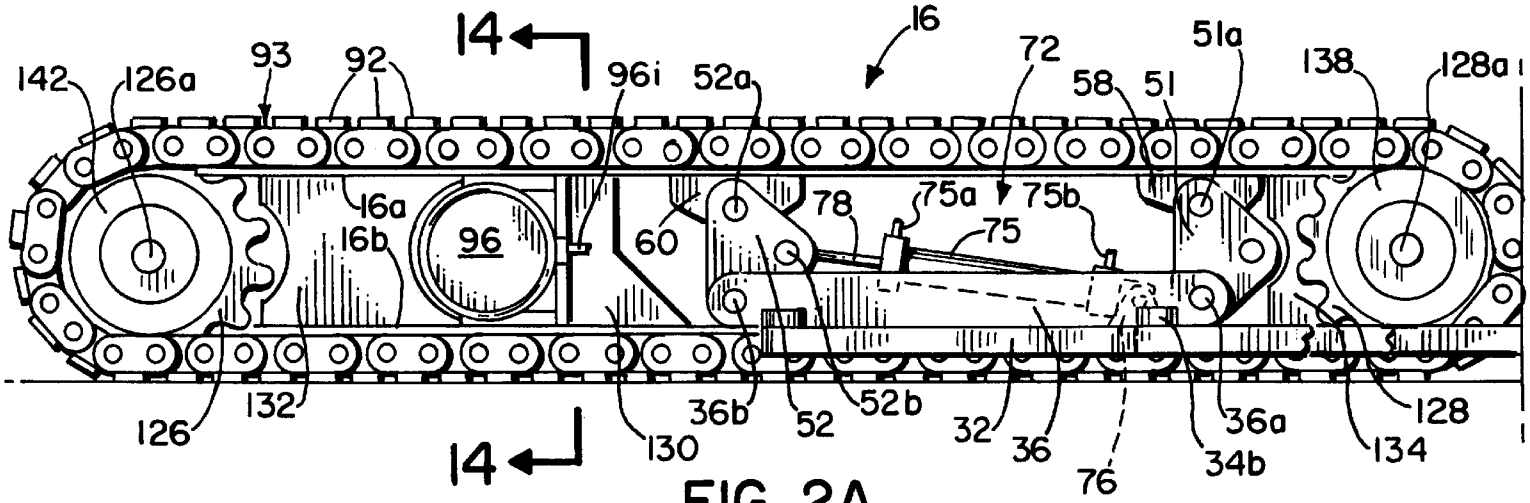
FIG. 2*a*, 2*b* and 2*c* combined show a schematic, side view, partially cut away, of the sludge removal apparatus shown in FIGS. 1*a*, 1*b*, and 1*c;*
Figure 2B:
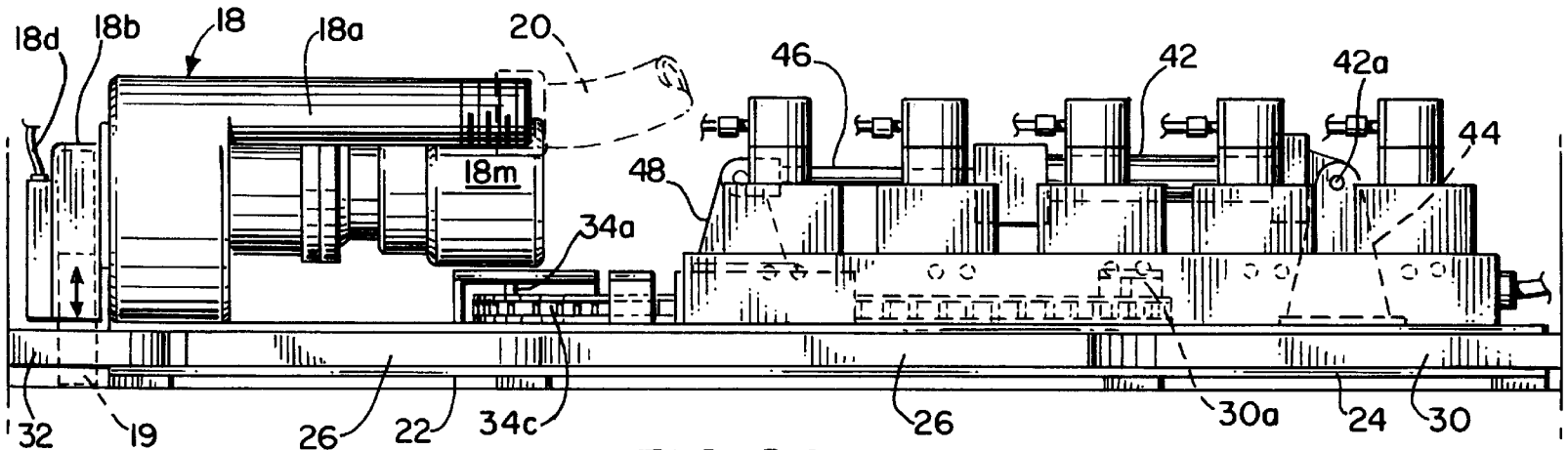

As can be seen in FIGS. 2B, 8, and 9, the principal components of chassis 12 are two generally rectangular flat parallel plates 22 and 24 which are attached to an elongated main support spacer 26. Main support spacer 26 is essentially a vertical wall which extends perpendicularly between plates 22 and 24 and rigidly connects plate 22 to plate 24. Plate 24 has two "eyes" 12*a* and 12*b* rigidly connected thereto to which cables or ropes 13—13 may be attached as shown in FIGS. 4–7 for lowering or raising sludge removal apparatus 10 in a tank 17 or other area being cleaned.

Track assembly 14 is connected to chassis 12 by swing arms 28 and 30, and track assembly 16 is connected to chassis 12 by swing arms 32 and 34. As shown in FIGS. 3, 5–7, and 9, track assemblies 14 and 16 are aligned parallel to each side of chassis 12 when apparatus 10 is in the operational or sludge removal configuration, and as shown in FIGS. 4 and 8, track assemblies 14 and 16 are aligned with chassis 12 at opposite ends of chassis 12 in the insertion configuration. Swing arms 28, 30, 32, and 34 enable track assemblies 14 and 16 to move in the same plane in which chassis 12 lies as shown in FIGS. 8 and 9, and to be alignable with chassis 12 as shown in FIGS. 1A, 1B, 1C, 2A, 2B, 2C, 4, and 8. When track assemblies 14 and 16 are aligned with the two ends of chassis 12 as shown in FIGS. 4 and 8, apparatus 10 presents the smallest profile or cross-sectional diameter, and apparatus 10 may be inserted through an access port such as access port or pipe 17*a* of tank 17 shown in FIG. 4 having an inside diameter of 12 inches.

Swing arms 28, 30, 32, and 34 are connected to rotatable pins 28*a*, 30*a*, 32*a* and 34*a*, respectively. Pins 28*a*, 30*a*, 32*a*, and 34*a* are rotatably connected to plates 22 and 24.

As shown in FIG. 9, main support spacer 26 separates and prevents swing arms 28 and 30 from contacting swing arms 32 and 34 when the swing arms are rotated from the position shown in FIG. 8 to the position shown in FIG. 9. Pins 30*a* and 34*a* are rigidly connected to swing arms 30 and 34, respectively. As can be seen in FIG. 3, pins 30*a* and 34*a* are rigidly connected to sprockets 30*d* and 34*d*, respectively.

Figure 11:
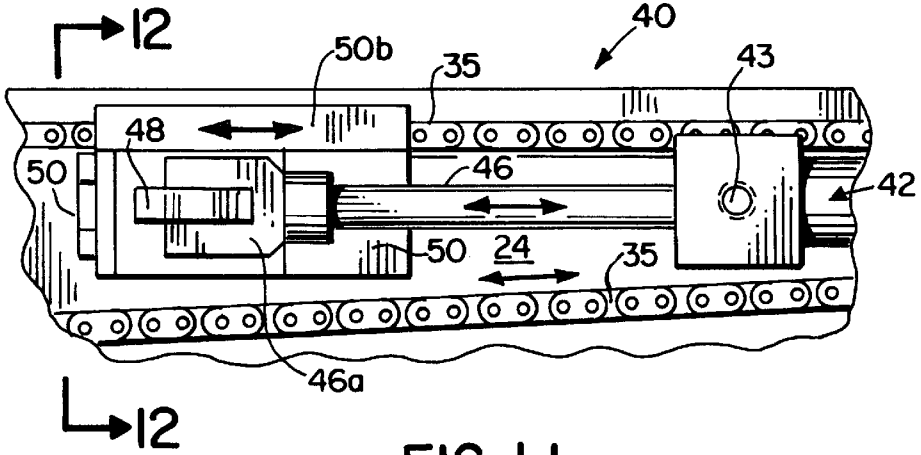
FIG. 11 is a schematic, partly cut-away, enlarged view of the drive assembly show in FIG. 1*b* and 3 for rotating the swing arms attached to the track assemblies.

Sprockets 30*d* and 34*d* are rotated clockwise and counterclockwise by the movement of chain 35 to and fro, as indicated by the arrows in FIG. 11, to rotate track assemblies 14 and 16 to and from the positions shown in FIGS. 8 and 9. FIG. 8 shows the track assemblies 14 and 16 located in the front and rear of chassis 12 in alignment with platform 12 to enable apparatus 10 to be inserted into a small opening 17*a* in tank 17. FIG. 9 shows the track assemblies 14 and 16 located at the sides of chassis 12 in position for driving the chassis 12 over the area from which sludge is to be removed.

Figure 1A:
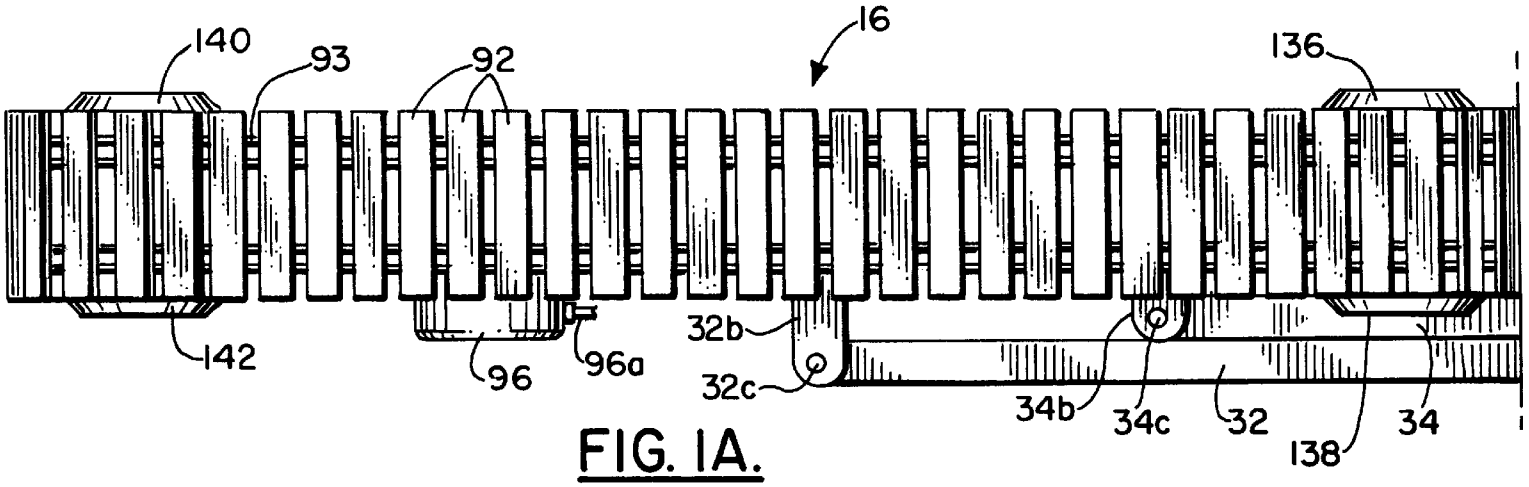
FIG. 1*a*, 1*b* and 1*c* combined show a schematic, top view, partially cut-away, of the sludge removal apparatus of the invention with the track assemblies aligned with the chassis for insertion into a pipe or access port.
Figure 1B:
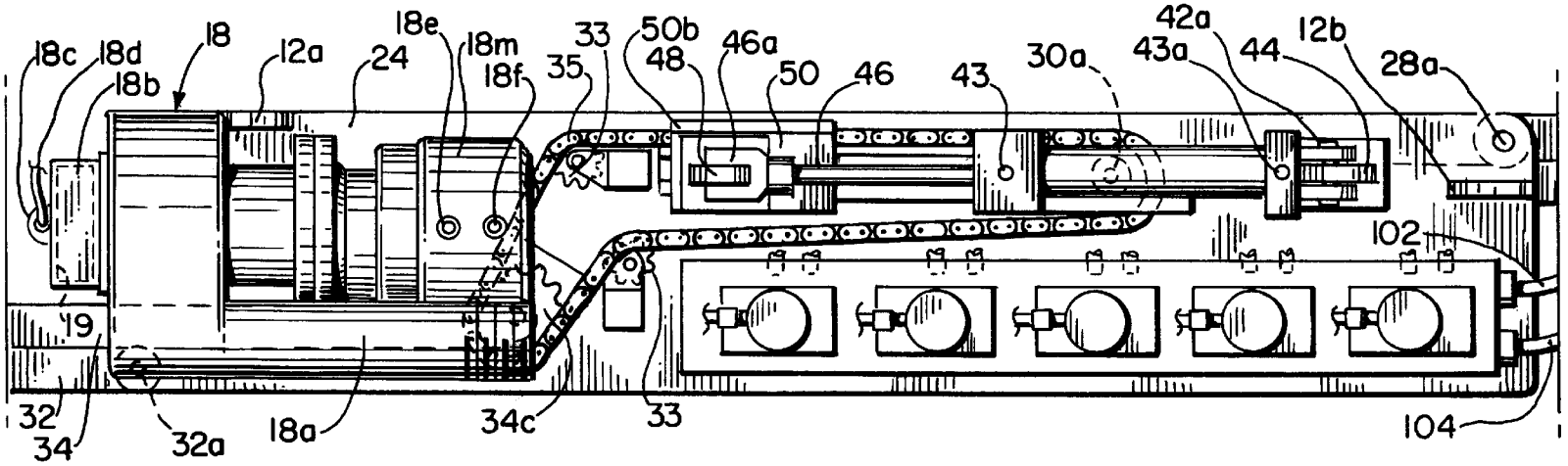
Figure 10:
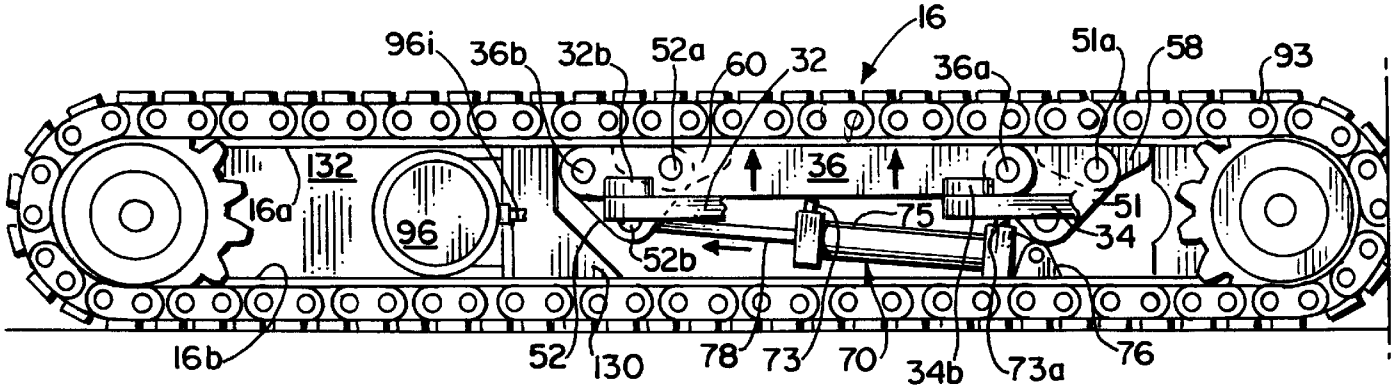
FIG. 10 is a schematic, side view of the track assembly shown in FIG. 2*a* with the chassis in the raised position shown in FIG. 7.

To rotate swing arms 28, 30, 32, and 34 to and from the positions shown in FIG. 4, 5, 8, and 9, chain 35 is driven over idler sprockets 33—33 and drive sprockets 30*d* and 34*d* by the chain drive assembly generally indicated by the numeral 40 shown in FIGS. 1B, 10 and 11. To rotate the swing arms from the position shown in FIG. 8 to the position shown in FIG. 3 and 9, idler sprockets 33—33 turn in the direction indicated by the arrows in FIG. 3 when chain 35 is moved in the direction indicated by the arrows in FIG. 3.

Figure 12:
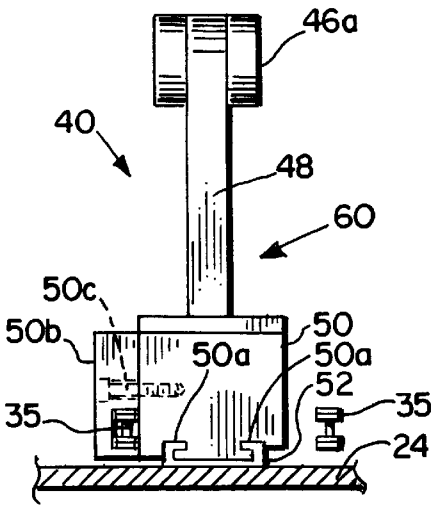
FIG. 12 is a schematic, cross-sectional view of taken along lines 12—12 of FIG. 11.

As can best be seen in FIGS. 3, 11, and 12, chain drive assembly 40 includes a hydraulic cylinder generally indicated by the numeral 42 which is pivotally connected at one end to bracket 44 by pin 42*a*. Hydraulic cylinder 42 is supplied with hydraulic fluid through a hose 43 and a hose 43*a*.

Hydraulic cylinder 42 has a rod 46 extending therefrom connected by clevis 46*a* to bracket 48 which can be selectively extended and withdrawn as indicated by the arrow in FIG. 11. Bracket 48 is rigidly connected to traveling block 50. As shown in FIG. 12, traveling block 50 has two elongated slots 50*a*–50*a* therein which slidably receive track 52. Track 52 is rigidly connected to the top of plate 24 to guide the back-and-forth movement of block 50 as block 50 drives chain 35 to and fro.

Block 50 has a chain engaging member 50*b* having a slot 50*d* for receipt of chain 35. Chain engaging member 50*b* is placed over chain 35 and connected to the side of block 50 by bolt 50*c* to connect block 50 to chain 35. Thus, when block 50 is moved by rod 46, chain 35 moves with block 50 in the direction of block 50.

Figure 1C:
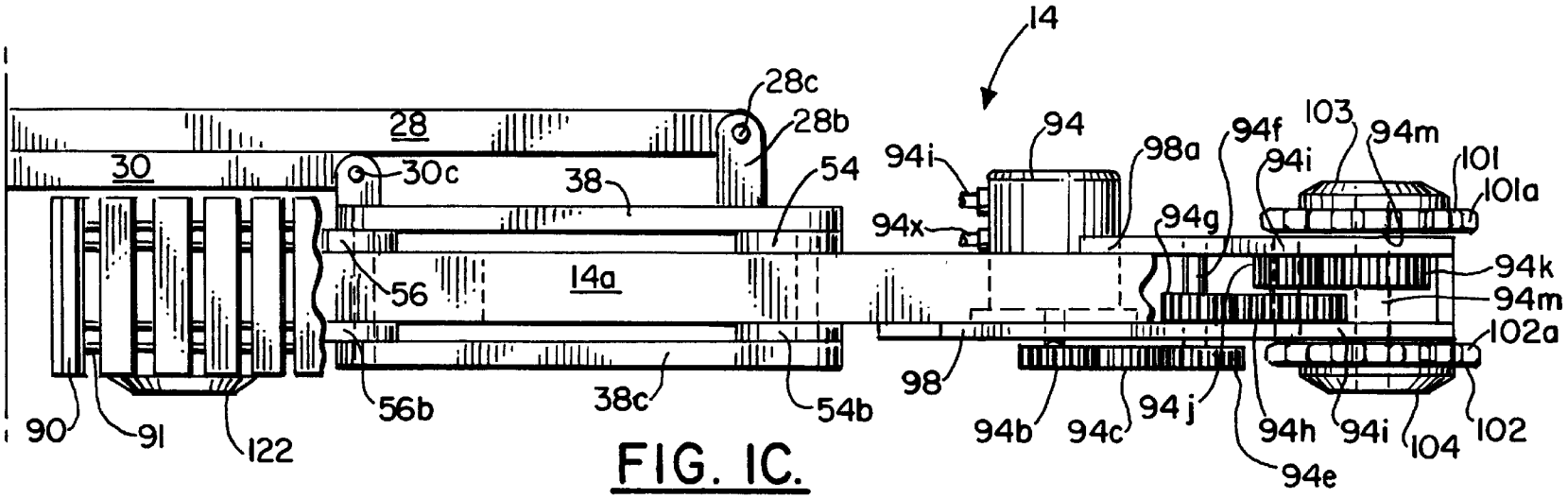
Figure 2C:
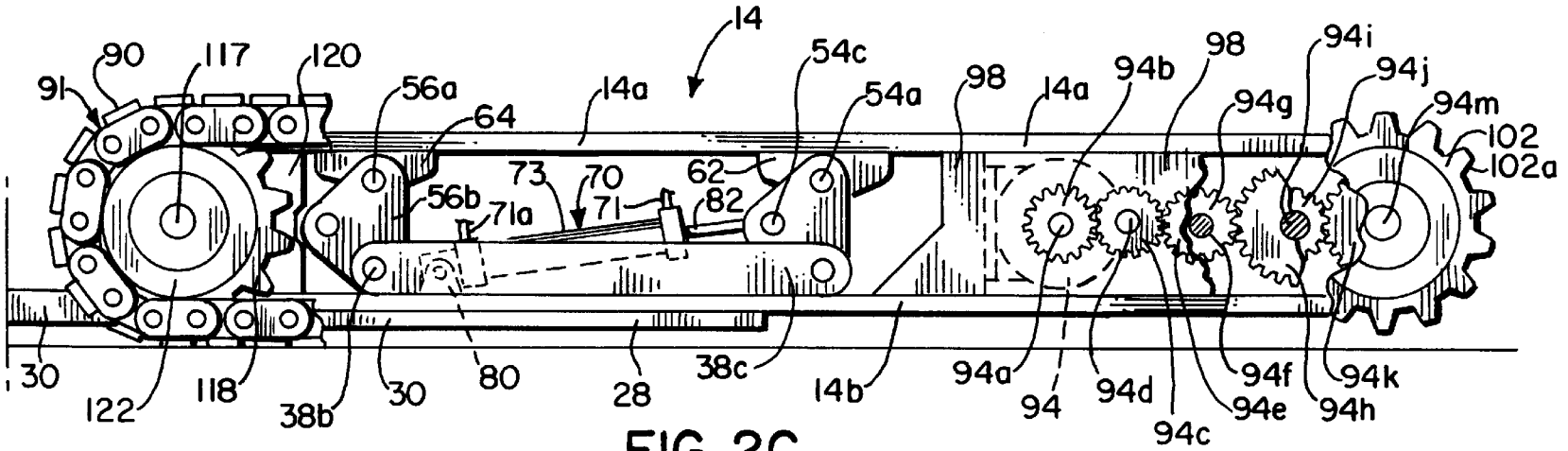

As can be seen in FIG. 2A, swing arms 32 and 34 are rotatably connected to elevator bar 36 of track assembly 16 by brackets 32*b* and 34*b*, respectively, and, as can be seen in FIGS. 1C and 2C, swing arms 28 and 30 are rotatably connected to elevator bar 38 of track assembly 14 by brackets 28*b* and 30*b*, respectively. Swing arms 28 and 30 are rotatably connected to brackets 28*b* and 30*b*, respectively, by pins 28*c* and 30*c*, respectively, and swing arms 32 and 34 are rotatably connected to brackets 32*b* and 34*b*, respectively, by pins 32*c* and 34*c*, respectively.

Elevator bar 36 has two pins 36*a* and 36*b* which extend through generally triangular-shaped swinger plates 51 and 52, respectively, and rotate therein when elevator bar 36 is lowered and elevated as shown in FIGS. 2A and 10. Elevator bar 38 is identical to elevator bar 36 and has two pins 38*a* and 38*b* which extend through generally triangular-shaped swinger plates 54 and 56, respectively, and rotate therein when elevator bar 38 is lowered and elevated.

Swinger plates 51 and 52 are rotatably connected to brackets 58 and 60, respectively, by pins 51*a* and 52*a*, and swinger plates 54 and 56 are rotatably connected to brackets 62 and 64, respectively, by pins 54*a* and 56*a*. Brackets 58 and 60 are rigidly connected to upper track support member 16*a*, and brackets 62 and 64 are rigidly connected to upper track support member 14*a*.

As shown in FIG. 1C and 2C, elevator bar 38 has an additional identically shaped elevator bar 38*c* connected thereto on the opposite side of the track assembly 14 by pins 38*a* and 38*b* which extend through swing arms 54*b*, 56*b*, respectively. As shown in FIGS. 2A and 10, elevator bar 36 has an additional identically shaped elevator bar (not shown) connected thereto on the opposite side of the track assembly 16 by pins 36*a* and 36*a* which extend through swing arms 51, 52, respectively.

As shown in FIGS. 1C and 2C, swinger plate 54 has an additional swinger plate 54*b* connected thereto on the opposite side of brackets 62 by pins 38*a*, 54*a*, and 38*c*. Swinger plate 56 has an additional plate 56*b* connected thereto on the opposite side of bracket 64 by pins 38*b* and 56*a*.

As shown in FIGS. 1A and 10, swinger plate 51 has an additional swinger plate (not shown) connected thereto on the opposite side of bracket 58 by pins 36*a* and 5*a*. Swinger plate 52 has an additional swinger plate (not shown) connected thereto on the opposite side of bracket 60 by pins 36*b*, 52*a*, and 52*b*.

Figure 7:
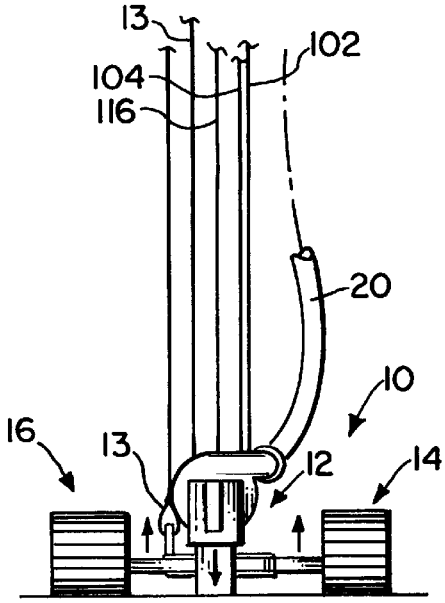
FIG. 7 is a schematic view of the chassis of the invention raised to its uppermost position relative to the two track assemblies 14 and 16.

As shown in FIGS. 2A and 2C, a hydraulic cylinder assembly generally indicated by the numeral 70 in track assembly 14 is connected to the inside of the lower track support member 14*b*, and a hydraulic cylinder assembly generally indicated by the numeral 72 in track assembly 16 is connected to the inside of lower track support member 16*b*. As shown in FIGS. 6 and 7, the purpose of hydraulic cylinder assemblies 70 and 72 is to lift the chassis 12 above the level of the track assemblies 14 and 16 after the insertion of apparatus 10 through an access port to prevent the chassis 12 from contacting and dragging on sludge as apparatus 10 is propelled over the sludge by track assemblies 14 and 16, and to lower the bottom of chassis 12 to the plane of the bottom of track assemblies 14 and 16 to provide the smallest possible profile when track assemblies 14 and 16 are aligned with chassis 12. Thus, apparatus 10 can be inserted through a smaller opening utilizing hydraulic cylinder assemblies 70 and 72.

As can be seen in FIGS. 2A and 10, hydraulic cylinder assembly 72 includes a cylinder generally indicated by the numeral 75 which is pivotally pinned at one end to bracket 76. Bracket 76 is rigidly connected to the inside of lower track support member 16*b*. Cylinder 75 has a rod 78 extending therefrom pivotally connected by pin 52*b* to swinger plate 52.

Rod 78 can be selectively extended and withdrawn as indicated by the arrows in FIG. 10 to raise and lower elevator bar 36. Elevator bar 38 is raised simultaneously with elevator 36 by hydraulic cylinder assembly 70 to raise chassis 12 above the sludge upon which the track assemblies 14 and 16 are supported.

Hydraulic cylinder assembly 70 shown in FIG. 2C is identical to hydraulic cylinder assembly 72 and includes a cylinder generally indicated by the numeral 73 which is pivotally pinned at one end to bracket 80. Bracket 80 is rigidly connected to the inside portion of lower track support member 14*b*. Cylinder 73 has a rod 82 extending therefrom pivotally connected by pin 54*c* to swinger plates 54 and 54*b* which can be selectively extended and withdrawn. Hydraulic cylinder 73 receives hydraulic fluid through hoses 71 and 71*a*, and hydraulic cylinder 75 receives hydraulic fluid through hoses 75*a* and 75*b*.

Connected to each of the track assemblies 14 and 16 are a plurality of tracks 90 and 92, respectively. Tracks 90 and 92 are conventional tracks rigidly connected to the track chains generally indicated by the numerals 91 and 93, respectively, as is well known in the art. One of the tracks 92 is shown in detail in FIG. 14. Each of the tracks 90 and 92 have a track support spacer 92*a* which makes sliding contact with upper and lower track support members 16*a* and 16*b*. Tracks 90 and 92, and all of the components of apparatus 10, can be made of stainless steel or other material which will not chemically interact with the chemical environment in which apparatus 10 is placed, nor cause any sparks or flame which might ignite the sediment or sludge being removed.

Figure 13:
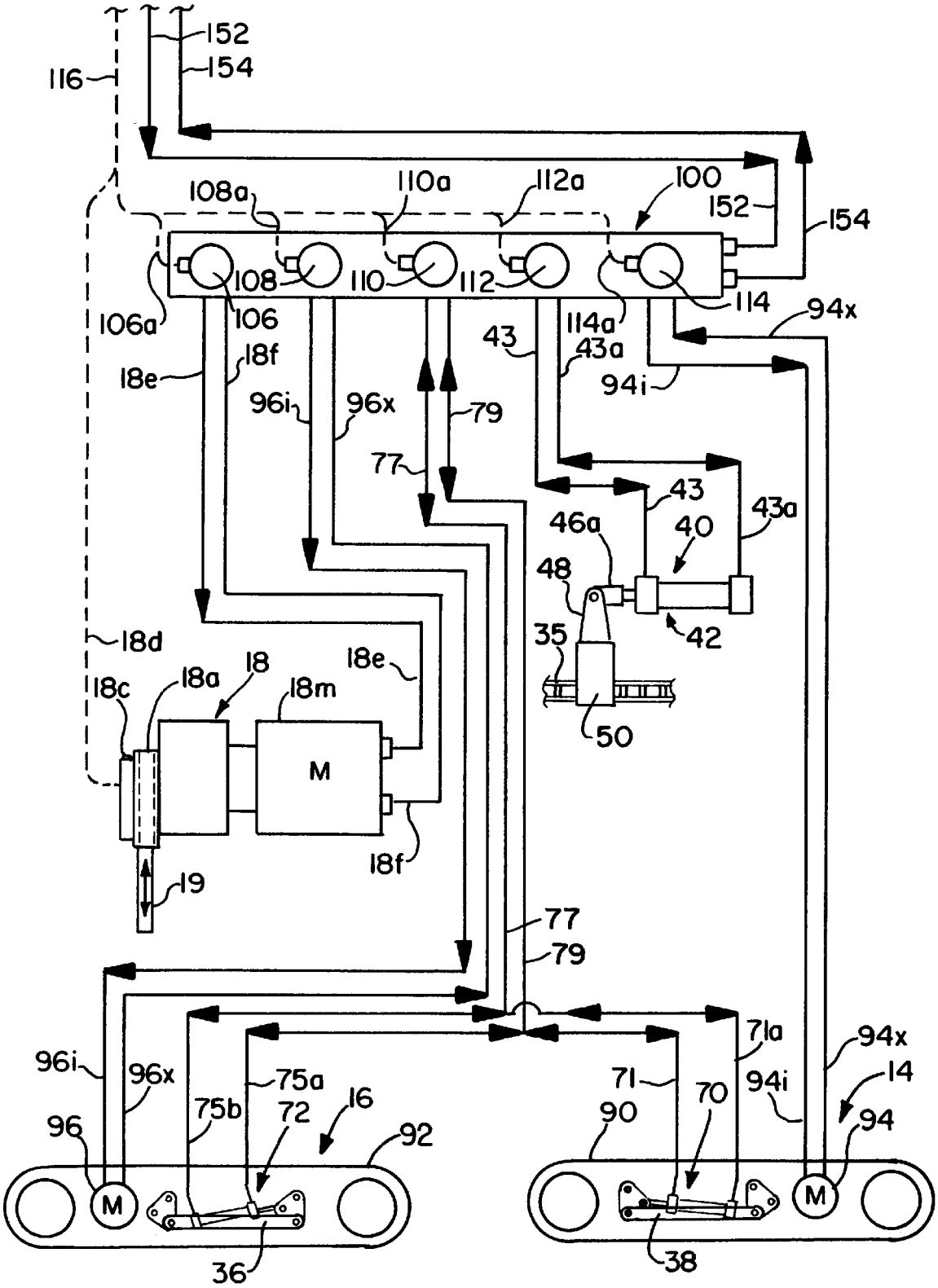
FIG. 13 is a schematic diagram of the electrical and hydraulic system used in the apparatus of the invention.

Track assemblies 14 and 16 are driven by motors 94 and 96, respectively. Motors 94 and 96 are preferably identical hydraulic motors which may be operated while submerged in liquid. As can be seen in FIGS. 1C and FIG. 13, motors 94 and 96 are supplied with hydraulic fluid through hydraulic hoses 94*i* and 96*i*, respectively.

Motor 94 is shown in FIGS. 1C and 2C. Motor 94 is connected to inner motor support plate 98, which is rigidly connected to upper track support member 14*a* and lower track support member 14*b* by welding, bolting, or the like. Motor 94 has a drive shaft 94*a* having a gear 94*b* rigidly connected thereto. Gear 94*b* meshes with idler gear 94*c*, which is rigidly connected to shaft 94*d*. Shaft 94*d* is rotatably connected to inner support plate 98. Idler gear 94*c* meshes with and drives gear 94*e*, which is rigidly connected to shaft 94*f*. Shaft 94*f* is rotatably connected to inner support plate 98 and outer support plate 98*a*.

A second gear 94*g* is rigidly connected to shaft 94*f* between inner support plate 98 and outer support plate 98*a*. Gear 94*g* meshes with and drives gear 94*h* which is rigidly connected to shaft 94*i* between inner support plate 98 and outer support plate 98*a*. Shaft 94*i* is rotatably connected to inner support plate 98 and outer support plate 98*a*.

A second gear 94*j* is rigidly connected to shaft 94*i* between inner support plate 98 and outer support plate 98*a*. Gear 94*j* meshes with and drives gear 94*k* which is rigidly connected to shaft 94*m* between inner support plate 98 and outer support plate 98*a*. Shaft 94*j* is rotatably connected to inner support plate 98 and outer support plate 98*a*.

Also connected to shaft 94*m* near each end thereof are drive sprockets 101 and 102. As shown in FIG. 1*c*, sprockets 101 and 102 have teeth 101*a* and 102*a* thereon which engage and drive chains 91 and 91*a* and the attached tracks 90. Caps 103 and 104 are connected to each end of shaft 94*m* to hold sprockets 101 and 102 on shaft 94*m*.

Two idler sprockets are rigidly connected to shaft 117 at the opposite end of track assembly 14 from drive sprockets 101 and 102. One of the two idler sprockets, numbered 118, is shown in FIG. 2C, and the other idler sprocket on the opposite end of shaft 117 is not shown.

As shown in FIG. 2C and FIG. 3, caps 122 and 124 are connected to each end of shaft 117. One end of shaft 117 is rotatably connected to idler support plate 120, and the other end of shaft 117 is connected to an idler support plate (not shown) identical to idler support plate 120. Idler support plate 120 and the idler support plate not shown are rigidly connected to upper track support member 14*a* and lower track support member 14*b* in the same manner as support plate 98 and support plate 98*a*.

Figure 14:
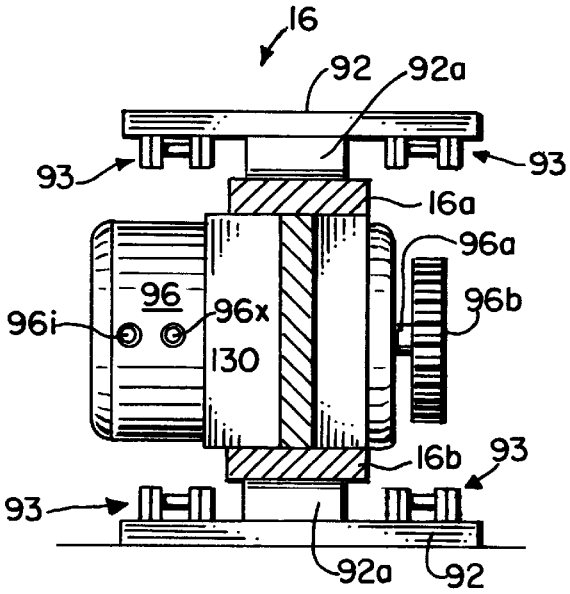
FIG. 14 is a cross-sectional view taken along lines 14—14 of FIG. 2A.

Referring now to FIG. 1A, 2A, and 3, track assembly 16 is identical to track assembly 14. Track assembly 16 has a drive sprocket 126 rigidly connected to shaft 126*a* identical to drive sprocket 101 and shaft 94*m*, respectively, of track assembly 14, and an idler sprocket 128 rigidly connected to shaft 128*a* identical to idler sprocket 118 and shaft 117, respectively, of track assembly 14. Support plate 130 is identical to support plate 98 of track assembly 14, and support plate 132 is identical to support plate 98*a* of track assembly 14. Idler support plate 134 is identical to idler support plate 120 of track assembly 14. Caps 136 and 138 are identical to caps 122 and 124, respectively, of track assembly 14, and caps 140 and 142 are identical to caps 104 and 103, respectively, of track assembly 14. As shown in FIG. 14, track assembly 16 has drive gear 96*b* connected to drive shaft 96*a* of hydraulic motor 96. Hydraulic motor 96 has all of the gears connected thereto as shown for hydraulic motor 98, since track assembly 16 is identical to track assembly 14.

As shown in FIG. 13, hydraulic fluid is supplied to the various components of the invention requiring hydraulic fluid from a hydraulic manifold generally indicated by the numeral 100. Hydraulic manifold 100 receives hydraulic fluid through hydraulic hose 152 from a hydraulic pump (not shown) which is located on the outside of the tank being cleaned by apparatus 10, and hydraulic fluid exits from manifold 100 through hose 154 to the hydraulic pump (not shown) supplying hydraulic fluid through hose 152. Manifold 100 has solenoids 106, 108, 110, 112, and 114 which control the flow of hydraulic fluid to the components of the invention. Solenoids 18*c*, 106, 108, 110, 112, and 112 are electrically controlled by signals received through electrical conductors 18*d*, 106*a*, 108*a*, 110*a*, 112*a*, and 114*a*, respectively. Electrical wires 106*a*, 108*a*, 110*a*, 112*a*, 114*a* and 18*d* are bundled together in wire bundle 116 which extends to the outside of the tank 17 or area in which apparatus 10 is being operated as shown in FIGS. 4, 5, and 6 to a conventional electronic control device located on the outside of the tank 17 or area being cleaned by apparatus 10.

Solenoid 106 receives electrical signals through electrical wires 106*a* to control the flow of hydraulic fluid through hydraulic hoses 18*e* and 18*f* to motor 18*m* which drives sludge pump 18. The direction of flow of hydraulic fluid through hydraulic hoses 18*e* and 18*f* is indicated by the arrows in FIG. 13.

Solenoid 108 receives electrical signals through electrical wires 108*a* to control the flow of hydraulic fluid through hydraulic hoses 96*i* and 96*x* to track motor 96 which drives tracks 92, and solenoid 114 receives electrical signals through electrical wires 114*a* to control the flow of hydraulic fluid through hydraulic hoses 94*i* and 94*x* to track motor 94 which drives tracks 90. The direction of flow of hydraulic fluid through hydraulic hoses 96*i* and 96*x*, and 94*i* and 94*x*, is indicated by the arrows in FIG. 13.

Solenoid 110 receives electrical signals through electrical wires 110*a* to control the flow of hydraulic fluid through hydraulic hoses 77 and 79 to and from hydraulic cylinder assembly 70 through hydraulic hoses 71 and 71*a* and to hydraulic cylinder assembly 72 through hydraulic hoses 75*a* and 75*b* to extend and retract rams 82 and 78 from hydraulic cylinders 73 and 75, respectively, to raise and lower chassis 12 as shown in FIGS. 7, and 10. The direction of flow of hydraulic fluid through hydraulic hoses 77, 79, 71, 71*a*, 75*a*, and 75*b* is indicated by the arrows in FIG. 13.

Solenoid 112 receives electrical signals through electrical wires 112*a* to control the flow of hydraulic fluid through hydraulic hoses 43 and 43*a* to chain drive assembly 40 which drives chain 35 to and fro to move track assemblies from the position shown in FIG. 8 to the position shown and FIG. 9. The direction of flow of hydraulic fluid through hydraulic hoses 43 and 43*a* is indicated by the arrows in FIG. 13.

To insert apparatus 10 into a tank 17 as shown in FIG. 4, track assemblies 14 and 16 are aligned with chassis 12, and apparatus 10 is hoisted by cables 13—13 into alignment with opening 17*a* in tank 17. When apparatus 10 is completely inside tank 17, track assemblies 14 and 16 are rotated into the position shown in FIG. 5, as indicated by the arrows in FIG. 5. The relative length of cables 13—13 is then adjusted to orient apparatus to the operating position with track assemblies 14 and 16 parallel to the bottom 17*b* of the tank 17, and apparatus 10 is lowered to the bottom 17*b* of tank 17 as shown in FIG. 6. Hydraulic cylinder assemblies 70 and 72 are then actuated to raise chassis 12 from the position shown in FIG. 6 to the position shown in FIG. 7, and hollow suction member 19 is lowered from the position shown in FIG. 6 to the position shown in FIG. 7 to place the bottom of member 19 in close contact with any sludge on the bottom 17*b* of tank 17.

If desired, additional tools or apparatus 150 indicated in phantom lines in FIG. 5 could be connected to apparatus 10 and be towed across the bottom on tank 17 to assist in reducing sludge found on the bottom on tank 17 to a smaller particle size for ease in pumping through pump 18. For example apparatus 150 could be a high pressure spraying apparatus for spraying a high pressure jet of liquid such as water onto a layer of sludge in the bottom 17*b* of tank 17 to comminute and form a slurry of sludge which may be pumped from tank 17 by pump 18.

Although the preferred embodiments of the invention have been described in detail above, it should be understood that the invention is in no sense limited thereby, and its scope is to be determined by that of the following claims:

What is claimed is:

1. A movable sediment and sludge removal apparatus for insertion into the access port of a storage tank containing sediment and sludge for pumping sediment and sludge from said tank, said movable sludge removal apparatus comprising:

a. a chassis, said chassis having two sides and two ends, b. a pump connected to the chassis for pumping sludge from said tank, c. a drive assembly pivotally connected to said chassis for supporting and moving said chassis and said pump around the inside of said tank to pump sludge from selected areas of said tank, said drive assembly being alignable with said chassis to enable said sludge removal apparatus to be inserted into an access port to said storage tank, said drive assembly comprising a first track assembly and a second track assembly, said first track assembly having a swing arm assembly pivotally connecting said first track assembly to said chassis, said second track assembly having a swing arm assembly pivotally connecting said second track assembly to said chassis, said swing arm assembly connecting said first track assembly to said chassis to enable said first track assembly to pivot on said swing arm assembly from a position at one side of said chassis to a position at one end of said chassis in alignment with said chassis, said swing arm assembly connecting said second track assembly to said chassis to enable said second track assembly to pivot on said swing arm assembly from a position at the other side of said chassis to a position at the other end of said chassis in alignment with said chassis.

2. The apparatus of claim 1 wherein said first track assembly and said second track assembly each have lifting piston assemblies for lifting said chassis relative to each of said track assemblies.

3. The apparatus of claim 2 wherein said lifting piston assemblies include a lifting bar connected which said swing arms are connected, and said lifting bar has piston means connected thereto to selectively raise and lower said lifting bar.

4. The apparatus of claim 1 wherein said swing arm assemblies are rotated by sprockets connected to each of swing arm assemblies and to a drive chain.

5. The apparatus of claim 4 wherein said drive chain is moved by a piston assembly.

6. The apparatus of claim 1 wherein tracks are connected to said first track assembly and said second track assembly to propel said apparatus around the inside of said storage tank.

7. The apparatus of claim 1 wherein a motor is connected to said drive assembly and to each of said track assemblies to drive said track assemblies.

8. A movable sediment and sludge removal apparatus for insertion into the access port of a storage tank containing sediment and sludge for pumping sediment and sludge from said tank, said movable sludge removal apparatus comprising:

a. a chassis, said chassis having two sides and two ends, b. a pump connected to the chassis for pumping sludge from said tank, c. a drive assembly means pivotally connected to said chassis for supporting and moving said chassis and said pump around the inside of said tank to pump sludge from selected areas of said tank, said drive assembly means being alignable with said chassis to enable said sludge removal apparatus to be inserted into an access port to said storage tank, said drive assembly means comprising a first track assembly and a second track assembly, said first track assembly having a swing arm assembly means for pivotally connecting said first track assembly to said chassis, and said second track assembly having a swing arm assembly means for pivotally connecting said second track assembly to said chassis, said swing arm assembly means connecting said first track assembly to said chassis to enable said first rack assembly to pivot on said swing arm assembly means from a first position at one side of said chassis to a second position at one end of said chassis in alignment with said chassis, and said swing arm assembly means connecting said second track assembly to said chassis to enable said second track assembly to pivot on said swing arm assembly means from a first position at the other side of said chassis to a second position at the other end of said chassis in alignment with said chassis.

9. The apparatus of claim 8 wherein said first track assembly and said second track assembly each have lifting piston assembly means for lifting said chassis relative to each of said track assemblies.

10. The apparatus of claim 9 wherein said lifting piston assembly means include a lifting bar to which said swing arm assembly is connected, and said lifting bar means has piston means connected thereto to selectively raise and lower said lifting bar.

11. The apparatus of claim 8 wherein said swing arm assembly means are rotated by sprockets connected to each of said swing arm assembly means and to a drive chain means for rotating said sprockets.

12. The apparatus of claim 11 wherein said drive chain means is moved by a piston assembly means.

13. The apparatus of claim 8 wherein tracks are connected to said first track assembly and said second track assembly to propel said apparatus around the inside of said storage tank.

14. The apparatus of claim 8 wherein a motor is connected to said drive assembly means and to each of said track assemblies to drive said track assemblies.

* * * * *